US006875314B2

(12) United States Patent
Korfer et al.

(10) Patent No.: US 6,875,314 B2
(45) Date of Patent: Apr. 5, 2005

(54) PAPER MACHINE CLOTHING, PARTICULARLY A PRESS FELT

(75) Inventors: Stefan Korfer, Monchengladbach (DE); Dieter Telgmann, Kreuzau (DE)

(73) Assignee: Heimbach GmbH & Co., Duren (DE)

( * ) Notice: Subject to any disclaimer, the term of this patent is extended or adjusted under 35 U.S.C. 154(b) by 35 days.

(21) Appl. No.: 10/355,117

(22) Filed: Jan. 31, 2003

(65) Prior Publication Data

US 2003/0148687 A1 Aug. 7, 2003

(30) Foreign Application Priority Data

Feb. 1, 2002 (DE) ..... 020024337

(51) Int. Cl.[7] ..... D21F 7/12

(52) U.S. Cl. ..... 162/358.2; 162/900; 428/222; 428/371; 428/399; 442/193; 442/195; 442/196

(58) Field of Search ..... 162/358.1, 358.2, 162/900–904, 348, 358.4; 139/383 A, 425 A, 426 R, 426 TW; 428/114, 222, 358, 364–365, 369–371, 397–400; 442/189–196, 270; 57/248; 34/116, 123

(56) References Cited

U.S. PATENT DOCUMENTS

| | | | | | |
|---|---|---|---|---|---|
| 2,551,175 | A | * | 5/1951 | Smith | 210/489 |
| 3,063,094 | A | * | 11/1962 | Warthen | 65/438 |
| 3,092,890 | A | * | 6/1963 | Bromley et al. | 428/152 |
| 3,109,278 | A | * | 11/1963 | Gibson, Jr. | 442/196 |
| 3,158,984 | A | * | 12/1964 | Butler | 57/210 |
| 4,392,902 | A | * | 7/1983 | Lefferts | 156/161 |
| 4,482,601 | A | | 11/1984 | Hartigan, Jr. | |
| 4,943,476 | A | * | 7/1990 | Sokaris | 442/187 |
| 5,134,010 | A | * | 7/1992 | Schiel | 428/113 |
| 5,361,808 | A | | 11/1994 | Bowen, Jr | |
| 5,449,548 | A | * | 9/1995 | Bowen, Jr. | 442/195 |
| 5,591,525 | A | | 1/1997 | Keller | |
| 6,352,772 | B1 | * | 3/2002 | Keller | 428/364 |
| 6,773,786 | B1 | * | 8/2004 | Kuckart | 428/141 |
| 6,790,796 | B2 | * | 9/2004 | Smith et al. | 442/189 |

FOREIGN PATENT DOCUMENTS

| | | |
|---|---|---|
| DE | 40 31 608 A1 | 4/1991 |
| DE | 40 40 861 C2 | 4/1994 |
| DE | 195 45 386 A1 | 6/1996 |
| DE | 199 00 989 A1 | 7/2000 |
| EP | 0 038279 A1 | 10/1981 |
| EP | 0 413 869 B1 | 2/1991 |
| EP | 0 307 182 B1 | 11/1991 |
| EP | 0 567 206 A1 | 10/1993 |
| EP | 0 394 293 B1 | 5/1994 |
| EP | 0 466 990 B1 | 3/1995 |
| EP | 0 996 835 A1 | 4/2000 |
| EP | 1 067 2398 A2 | 1/2001 |
| GB | 1053282 | 12/1966 |
| WO | WO 92/17643 | 10/1992 |
| WO | WO 98/07925 | 2/1998 |

* cited by examiner

*Primary Examiner*—Steven P. Griffin
*Assistant Examiner*—Eric Hug
(74) *Attorney, Agent, or Firm*—Liniak, Berenato & White, LLC

(57) ABSTRACT

This invention relates to paper machine clothing, particularly a press felt, comprising a support and comprising filaments which are formed as profiled monofilaments (1, 5, 6, 7, 8, 13, 18, 23, 24, 25) with a profile which differs from a circular cross-section, which is characterised in that profiled monofilaments (1, 5, 6, 7, 8, 13, 18, 23, 24, 25) are present which are helically profiled.

23 Claims, 2 Drawing Sheets

PAPER MACHINE CLOTHING, PARTICULARLY A PRESS FELT

FIELD OF THE INVENTION

This invention relates to paper machine clothing, particularly a press felt, comprising a support and comprising filaments which are formed as profiled monofilaments with a profile which differs from a circular cross-section, wherein profiled monofilaments are present which are helically profiled.

BACKGROUND OF THE INVENTION

Paper machine clothing comprises circulating belts of considerable length and width in paper machines, and is used for forming and guiding the paper web through the paper machine. Its construction thereof strongly depends on the parts of the paper machine in which it is used. In the first two parts of a paper machine, the sheet forming section and the press section, the paper machine clothing has to be designed so that the paper web is dewatered as thoroughly as possible, so that the energy consumption for thermal drying in the subsequent drying section remains low. Dewatering occurs through the paper machine clothing, i.e. the latter has to be constructed so that the liquid coming from the paper web is transported as efficiently as possible to the other side of the paper machine clothing.

In order to ensure this, very different designs of paper machine clothing have been developed. Forming screens, which generally consist of a woven fabric as a support, are provided for the sheet forming section. Pure woven fabrics such as these have also already been proposed for the press section. However, under the high pressure in the presses of the press section they tend to form marks in the paper web, which is why what are termed press felts are commonly used, as before, in which a support is embedded in a fibrous matrix. In particular, the support serves to withstand the tensile forces acting on the paper machine clothing, and is principally formed as a woven fabric, wherein the support can also be formed from a plurality of supporting lengths which are not joined to each other. A fibrous web, which protects the support from abrasion and which ensures flat surfaces, is then needle-bonded to one or both sides of the support.

Instead of a woven fabric consisting of longitudinal and transverse filaments, other textile filament constructions can also be used for the support, such as knitted fabrics, fibre lay-ups or fibre assemblages (see EP-B-0 394 293, EP-A-0 038 276). Different types of formed products consisting of filaments can also be combined with each other, as is shown, for example from DE-C 40—40 861. In addition, supports consisting of meshes are also known (see WO 92/17643; EP-B-0 307 182).

The filaments of which textile supports consist generally have a circular cross-section. Filaments of flat, rectangular cross-section are also used for certain purposes. In addition, there is a series of proposals which have been made and which relate to other cross-sectional shapes of filaments for the supports of paper machine clothing or for the fibres of nonwoven supports, some of which are strongly profiled (DE-A-40 31 608; U.S. Pat. No. 5,361,808; DE-A-195 45 386; U.S. Pat. No. 5,591,525; EP-A-1 067 239; DEA-199 00 989; EP-A-0 995 835). These filaments or fibres are profiled for very different reasons. A common feature of all filaments or fibres is that the profile extends longitudinally, i.e. it extends along the axis of the respective filament.

An important object for press felts in particular is to fashion their structure so that dewatering occurs as effectively as possible. For this purpose, it is important that the paper machine clothing has a good liquid absorption capacity and a low resistance to flow. Efforts are therefore made, whilst taking other requirements such as strength, freedom from marks and the like into consideration, to provide an open volume which is as high as possible inside the paper machine clothing.

In order to achieve this object, it is proposed in GB-A-1 053 282 and U.S. Pat. No. 3,158,984 that profiled monofilaments of very different cross-sectional shapes are used, which are twisted helically so that helical profiling results. The monofilaments are twisted independently of each other about their longitudinal axis and are fixed in this state inside the support.

On account of the individual twisting of the monofilaments, the production of a support such as this is complicated, which is why paper machine clothing such as this has not found widespread use. Moreover, it is very difficult to achieve uniform twisting of the monofilaments and thus to achieve uniform dewatering properties over the surface. Furthermore, monofilaments tend to untwist depending on the inherent stress, with corresponding effects on the dewatering properties.

The underlying object of the present invention is to fashion paper machine clothing of the type cited at the outset so that good dewatering properties are achieved by a simple manufacturing process.

SUMMARY OF THE INVENTION

This object is achieved according to the invention in that the helical profiling has already been imparted to the profiled monofilaments during the manufacture thereof and they are therefore present free from torsional stress in the paper machine clothing. The basic idea of the invention is therefore to use monofilaments for the support, the helical profiling of which monofilaments has already been imparted during manufacture, for example during extrusion through corresponding shapes of dies or during subsequent stretching, so that the monofilaments are present free from stress in the support. Monofilaments such as these can be manufactured very accurately with regard to their helical profile. Due to their freedom from torsional stress, they do not change their shape in operation. Good dewatering properties are therefore achieved which are uniform over the surface, and the support can be manufactured in a customary manner from the pre-formed monofilaments. The individual twisting of the monofilaments which is necessary in the prior art is dispensed with.

There is considerable freedom with regard to the form of the cross-sections of the helically profiled monofilaments. Thus they can have an oval, trilobular, polygonal, square, rectangular, clover leaf-shaped and/or triangular cross-section, and the cross-sections do not even have to be regular or symmetrical. Monofilaments of different cross-sections can also be present in order to exert an effect on the pore volume and thus on the dewatering properties, depending on the requirements. A particularly high pore volume is achieved if helically profiled monofilaments are present, the cross-section of which comprises a plurality of curved indentations distributed over the periphery. Conversely, however, curved protrusions distributed over the periphery can also be provided, or both can be combined with each other so that curved indentations and curved protrusions are distributed alternately over the periphery. At the same time, helically extending sharp or rounded edges can also be present.

It has proved to be advantageous if the profile of the helically profiled monofilaments has two to forty turns over 10 cm, i.e. if the cross-section of the monofilaments rotates by two to forty times over this length. The pore volume and thus the dewatering properties can also be influenced by the number of turns. Monofilaments with a different number of turns can also be provided.

The pore volume, and thus the dewatering capacity, can also be influenced by the number of helically profiled monofilaments. Advantageously, at least 30% of the filaments which extend in a longitudinal and/or transverse direction should be helically profiled monofilaments, wherein all the longitudinal and/or transverse filaments can also be monofilaments such as these.

In principle, it is all also possible for the helically profiled monofilaments to be processed to form twists, for example in a manner such that there is a plurality of helically profiled monofilaments which are twisted with each other. It is also possible, however, for one or more helically profiled monofilaments to be twisted with monofilaments of other forms, for example with stretched profiled monofilaments or with round monofilaments and/or with multifilaments. Alternatively, it is possible for helically profiled monofilaments to be present around which a spun fibre yarn is wound or which are twisted with a spun fibre yarn, as has already been described in EP-B- 0 94 293. These monofilaments should be disposed so that they extend side by side and are parallel to each other.

In a further embodiment of the invention, provision is made for the helically profiled monofilaments around which a spun fibre yarn is wound or which are twisted with a spun fibre yarn to form a twist comprising at least one filament of a material, particularly polyvinyl alcohol, which is soluble in a solvent, preferably water, in which the helically profiled monofilament and the spun fibre yarn are insoluble. After they have been introduced into the paper machine clothing, the soluble fibres can be dissolved out by treatment with the solvent, whereby additional free volume is formed in the paper machine clothing. A procedure such as this for the purpose of producing pore volumes is known in principle (see U.S. Pat. No. 4,482,601; EP-B-0 466 990; EP-B-0 413 869; EP-A-0 565 206; WO 98/07925). In particular, the filaments of the soluble material should be twisted with the helically profiled monofilaments so that they form spacers between adjacent filaments.

The helically profiled monofilaments do not have to form part of the support of the paper machine clothing, but may also extend outside the support, as filling filaments or the like for example. Advantageously, however, they at the same time form part of the support, wherein the support may also completely consist of monofilaments such as these. The support can be any type of product formed from thread or filaments, for example a woven fabric, knitted fabric, lay-up and/or a filament assemblage. Mesh supports can also be provided as supports, and are then combined with the helically profiled monofilaments.

Due to the use of helically profiled monofilaments, there are also no restrictions with regard to the layer structure of the support, i.e. the support can be of single-layer or multi-layer construction, or can consist of a plurality of supporting lengths which are not joined to each other by filaments and which are either of identical construction or are different. The support can also be formed from a woven fabric, a knitted fabric and/or a mesh and may additionally comprise a lay-up or a filament assemblage.

For use in a press felt, it is advantageous if the support is embedded in a fibrous matrix, for example by surrounding it between at least two fibrous layers which are needle-bonded to each other.

The materials which are customary for paper machine clothing can be used as the material of the helically profiled monofilaments, and of the spun fibre yarns if applicable. In particular, these materials are thermoplastic polymers. Examples thereof include polypropylene, polyamide 4,6, polyamide 6, polyamide 6,6, polyamide 6,10, polyamide 6,12, polyamide 11, polyamide 12, PET, PTT, PBT, PPS, PEK or PEEK. Elastomeric polyesters can also be used.

The invention is illustrated in greater detail, with reference to examples of embodiments, in the drawings, where:

DETAILED DESCRIPTION OF THE PREFERRED EMBODIMENTS

Figure 1:
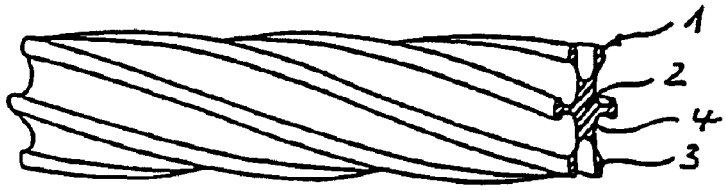
FIG. 1 shows a portion of the monofilament according to the invention.
Figure 2:
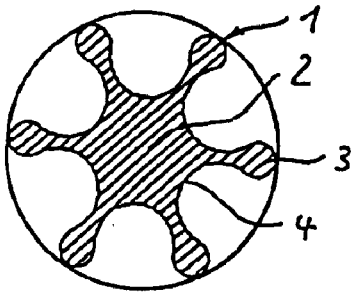
FIG. 2 is a cross-section through the monofilament shown in FIG. 1.
Figure 3:
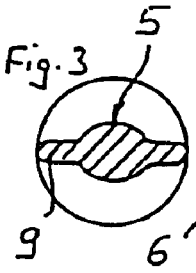
FIGS. 3 to 11 show various cross-sections of monofilaments according to the invention.
Figure 4:
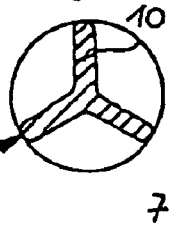
Figure 5:
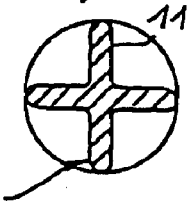
Figure 6:
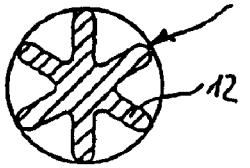

The monofilament 1 which is illustrated in FIGS. 1 and 2 has a rotationally symmetric cross-section comprising a core 2 and a total of six radially outwardly projecting ribs—denoted by 3, for example—which are spherically enlarged at their ends. The ribs 3 surround deep, curved indentations between them—denoted by 4, for example—which form grooves over the length of the monofilament 1.

As can be seen from FIG. 1, the profile of the monofilament 1 is of helical form, namely its external shape is twisted so that the ribs 3, and the grooves formed by the curved indentations 4 also, extend helically around the core 2 of the monofilament 1. If monofilaments 1 such as these are woven into the support of paper machine clothing, this thereby results in a pore volume, wherein the grooves formed by the curved indentations 4 form dewatering channels.

FIGS. 3 to 6 illustrate other embodiments of monofilaments 5, 6, 7, 8 according to the invention. These are also rotationally symmetrical and have a different number of radially extending ribs—denoted by 9, 10, 11, 12, for example.

Figure 7:
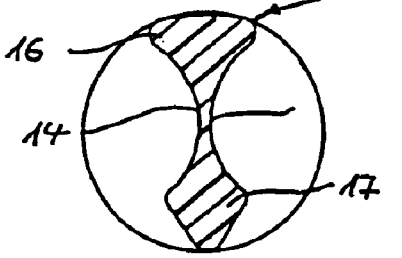

FIG. 7 shows a monofilament 13 according to the invention which is simply mirror-symmetrical. It comprises two opposite curved indentations 14, 15 which extend on both sides into thickened portions 16, 17 of different form.

Figure 8:
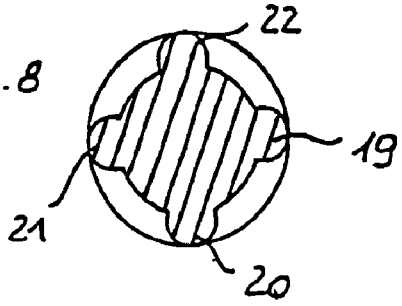

FIG. 8 illustrates a helically profiled monofilament 18 which is rotationally symmetrical in form and which comprises four curved protrusions 19, 20, 21, 22 distributed over its periphery, wherein the curved protrusions 19, 20, 21, 22 are joined by convex regions. Groove-like indentations are also formed in this profile.

Figure 9:
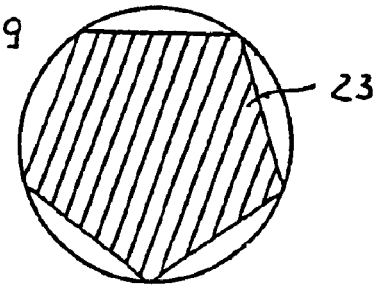
Figure 10:
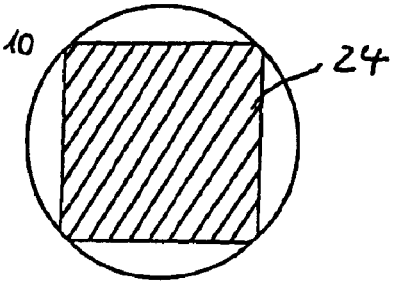
Figure 11:
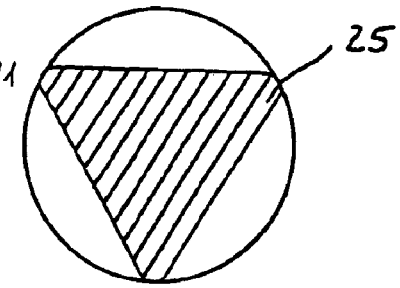

FIGS. 9 to 11 are cross-sections through further helically profiled monofilaments 23, 24, 25, comprising a regular pentagon (FIG. 9), a square (FIG. 10) and a triangle (FIG. 11). Even though the joints between the corners of these monofilaments 23, 24, 25 form straight lines, pore volume and dewatering channels are formed due to the helical profile.

What is claimed is:

1. Press felt paper machine clothing comprising:

a support structure, and filaments, including monofilaments having a pre-formed helical profile, said helical monofilanients extending in a linear manner so that said pre-formed helical monofilaments are free from torsional stress.

2. Paper machine clothing according to claim 1, wherein each of said helical monofilaments have one of an oval, trilobular, polygonal, square, rectangular, clover leaf-shaped or triangular cross-section.

3. Paper machine clothing according to claim 1, wherein each of said helical monofilaments has a cross-section comprising a plurality of curved indentations distributed over a periphery of each of said monofilaments.

4. Paper machine clothing according to claim 1, wherein each of said helical monofilaments has a cross-section comprising a plurality of curved protrusions distributed over a periphery of each of said monofilaments.

5. Paper machine clothing according to claim 3 wherein each of said helical monofilaments has a cross-section comprising curved indentations and curved protrusions distributed alternately over a periphery of each of said monofilaments.

6. Paper machine clothing according to claim 1, wherein each of said helical monofilaments has a profile comprising helically extending sharp edges.

7. Paper machine clothing according to claim 1, wherein each of said helical monofilaments has a profile comprising helically extending rounded edges.

8. Paper machine clothing according to claim 1, wherein each of said helical monofilarnents has two to forty turns over a length of 10 cm.

9. Paper machine clothing according to claim 1, wherein at least 30% of said filaments extending in one of a longitudinal or a transverse direction are said helical monofilaments.

10. Paper machine clothing according to claim 1, wherein said filaments further comprise non-helical monofilaments and multifilaments, said helical monofilaments being intertwined with said non-helical monofilaments and said multifilaments, said helical monofilaments also being intertwined with other said helical monofilaments.

11. Paper machine clothing according to claim 1, wherein spun fiber yarn is wound around said helical monofilaments to form yarn wrapped helical monofilaments, said spun fiber yarn also being intertwined with said helical monofilaments.

12. Paper machine clothing according to claim 11, wherein said yarn-wrapped helical monofilaments are disposed parallel to each to each other.

13. Paper machine clothing according to claim 11, wherein said filaments further comprise solvent-soluble filaments, said yam-wrapped helical monofilaments being intertwined with said solvent-soluble filaments to form a filament material, said spun fiber yarn and said helical monofilaments being insoluble.

14. Paper machine clothing according to claim 13, wherein said solvent-soluble filaments are comprised of polyvinyl alcohol.

15. Paper machine clothing according to claim 13, wherein said solvent-soluble filaments are intertwined with said helical monofilaments so that said solvent-soluble monofilaments form spacers.

16. Paper machine clothing according to claim 1, wherein said helical monofilaments comprise said support structure.

17. Paper machine clothing according to claim 1, wherein said support structure is comprised of at least one of a woven fabric, a knitted fabric, a lay-up, a filament assemblage or a mesh support.

18. Paper machine clothing according to claim 1, wherein said support structure has one of a single-layer or a multi-layer construction.

19. Paper machine clothing according to claim 1, wherein said support structure consists of a plurality of said filaments having supporting lengths which are not joined together by other said filaments.

20. Paper machine clothing according to claim 1, wherein said support structure is formed from at least one of a woven fabric, a knitted fabric or a mesh, said support structure further comprising one of a lay-up or a filament assemblage.

21. Paper machine clothing according to claim 1, wherein said support structure is embedded in a fibrous matrix.

22. Paper machine clothing according to claim 21, wherein said support structure is disposed between at least two fibrous layers.

23. Paper machine clothing according to claim 1, wherein said helical monofilaments and said spun fiber yarns are comprised of a thermoplastic polymer selected from a group consisting of polypropylene, polyamide 4,6, polyanilde 6, polyamide 6, 6, polyaniide 6, 10, polyamide 6, 12, polyamide 11, polyamide 12, PET, PTT, PBT, PPS, PEK, PEEK, and an elastomeric polyester.

* * * * *